US005956051A

United States Patent [19]

Davies et al.

[11] Patent Number: 5,956,051

[45] Date of Patent: Sep. 21, 1999

[54] DISABLING A MAILING MACHINE WHEN A PRINT HEAD IS NOT INSTALLED

[75] Inventors: Brad L. Davies, Trumbull; George T. Monroe, Seymour; Maria P. Parkos, Southbury, all of Conn.

[73] Assignee: Pitney Bowes Inc., Stamford, Conn.

[21] Appl. No.: 08/864,942

[22] Filed: May 29, 1997

[51] Int. Cl.[6] ..... B41J 3/00; B41J 29/393

[52] U.S. Cl. ..... 347/2; 347/19

[58] Field of Search ..... 347/19, 49, 2

[56] References Cited

U.S. PATENT DOCUMENTS 5,638,097 6/1997 Takayanagi et al. ..... 347/7
5,699,091 12/1997 Bullock et al. ..... 347/19

FOREIGN PATENT DOCUMENTS 2-162046 6/1990 Japan ..... 347/19

*Primary Examiner*—N. Le
*Assistant Examiner*—Thien Tran
*Attorney, Agent, or Firm*—Angelo N. Chaclas; Melvin J. Scolnick

[57] ABSTRACT

Mailing machine including a controller, a printer module including a connector, a print head controller for producing print data signals necessary to print a postal indicia on an envelope and a replaceable print head cartridge having a plurality of print elements which are selectively energizable in response to the print data signals. The print head cartridge is detachably mounted to the connector. The controller in operative communication with the printer module for: determining if a valid print head cartridge is installed; and if a valid print head cartridge is not installed, preventing the print data signals from reaching the connector.

12 Claims, 5 Drawing Sheets

DISABLING A MAILING MACHINE WHEN A PRINT HEAD IS NOT INSTALLED

FIELD OF THE INVENTION

This invention relates to disabling a mailing machine having a conveyor apparatus and a print controller when the print head is not installed. More particularly, this invention is directed to disabling the print controller from supplying print data signals and/or disabling the mailing machine conveyor apparatus when a print head is not installed.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver and control electronics for controlling the ejection elements. Typically, the array of nozzles end the ejection elements along with their associated components are referred to as a print head. It is the activation of the ejection elements which causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed.

Recently, the postage meter industry and other envelope printing industries have begun to incorporate ink jet printers having a user replaceable ink jet cartridge. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user pays to the Postal Service the amount of postage to be credited to the meter and the meter is recharged by increasing the setting of the descending register by the amount paid. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Generally, the postage meter may be incorporated into a mailing machine, which is also well known in the art, for automated handling of the mailpieces. Mailing machines are readily available from manufactures such as Pitney Bowes Inc. of Stamford, Conn., USA and often include a variety of different modules which automate the processes of producing mailpieces. The typical mailing machine includes a variety of different modules or sub-systems where each module performs a different task on a mailpiece, such as: singulating (separating the mailpieces one at a time from a stack of mailpieces), weighing, sealing (wetting and closing the glued flap of an envelope), applying evidence of postage, accounting for postage used (performed by the postage meter), feeding roll tape or cut tape strips for printing and stacking finished mailpieces. However, the exact configuration of each mailing machine is particular to the needs of the user. Customarily, the mailing machine also includes a transport apparatus which feeds the mailpieces in a path of travel through the successive modules of the mailing machine.

To print a valid postal indicia the postage meter (accounting module) and the printer must work cooperatively to ensure that the value of the postal indicia which is printed is properly accounted for. Because there is a physical separation between the postage meter and the printer, there is a risk of fraud due to an intruder breaking into the communications between the postage meter and the printer.

One risk that is present is due to the user replaceable ink jet cartridge. When the ink jet cartridge is not present, print data signals from the print head controller are exposed to external interrogation at the ink jet cartridge connector. Thus, it would be possible to operate the mailing machine without the ink jet cartridge installed and capture the print data signals and replay them at a later time to produce fraudulent postal indicias.

Another risk is use of the mailing machine with an unauthorized printer. That is, if the unauthorized printer were capable of producing fraudulent postal indicias, then the mailing machine could be used to automate the handling and feeding of the mailpieces. In this manner, the exposure to fraud would be much greater than for a hand fed printer due to the increased throughput capabilities of the mailing machine. Thus, numerous fraudulent postal indicias could be produced.

Therefore, there is a need for a mailing machine including an ink jet printer having an ink jet cartridge wherein the mailing machine discourages fraudulent use of the mailing machine. More particularly, there is a need for preventing unauthorized interception of the print signals from the print head controller to the print head and unauthorized use of the mailing machine to feed and process envelopes. In this manner, the postal authority does not suffer a loss of funds.

SUMMARY OF THE INVENTION

The present invention provides an apparatus, method and method of manufacturing a mailing machine which substantially reduces the risk of fraud as described above.

In accordance with the present invention, there is provided a mailing machine including a controller, a printer module including a connector, a print head controller for producing print data signals necessary to print a postal indicia on an envelope and a replaceable print head cartridge having a plurality of print elements which are selectively energizable in response to the print data signals. The print head cartridge is detachably mounted to the connector. The controller in operative communication with the printer module for: determining if a valid print head cartridge is installed; and if a valid print head cartridge is not installed, preventing the print data signals from reaching the connector.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
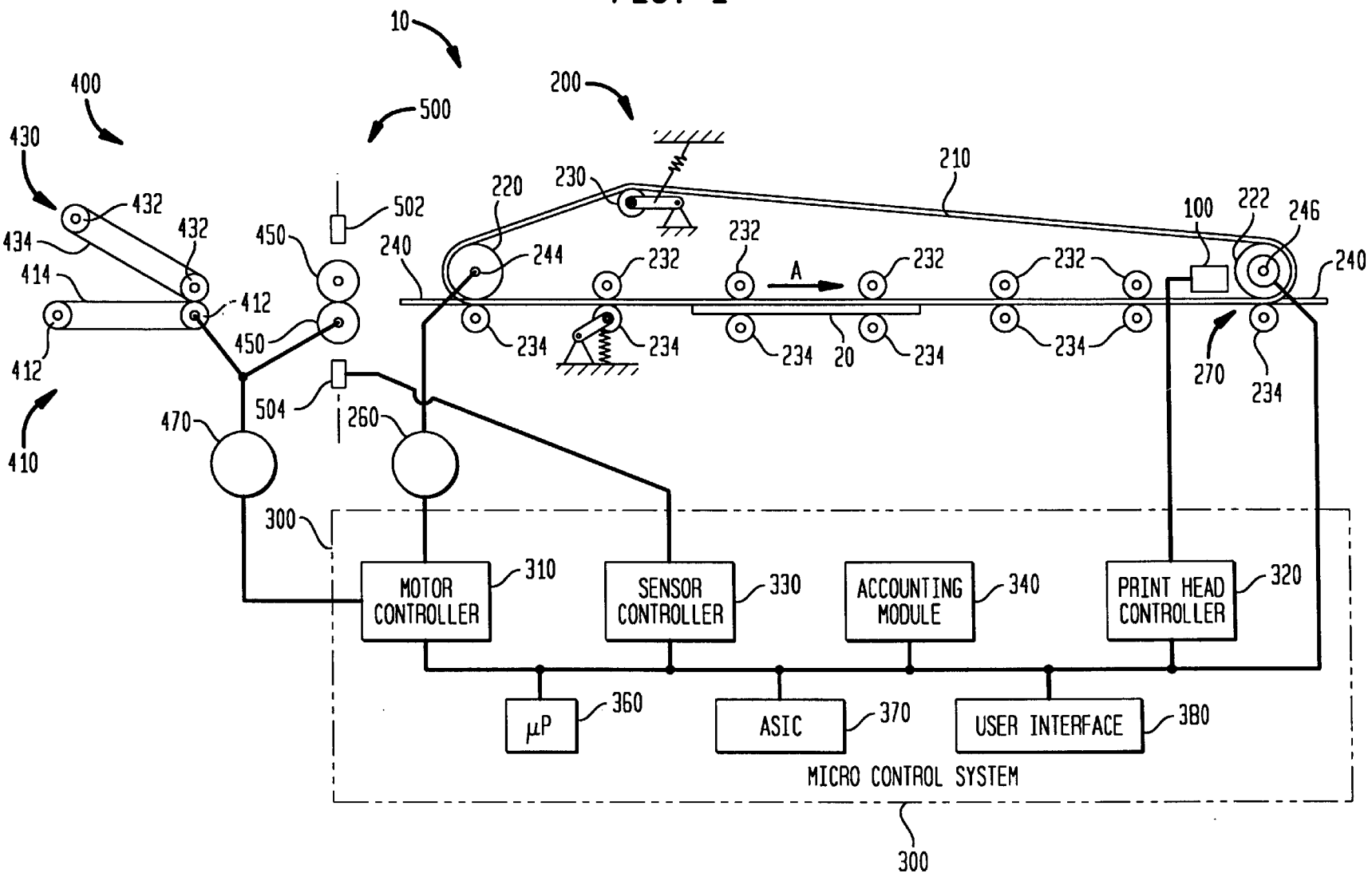
FIG. 1 is a simplified schematic of a front elevational view of a mailing machine which incorporates the present invention.

Referring to FIG. 1, an example of a mailing machine 10 in which the present invention may be incorporated is shown. The mailing machine 10 includes a printer module 100, a conveyor apparatus 200, a micro control is system 300 and a singulator module 400. Other modules of the mailing machine 10, such as those described above, have not been shown for the sake of clarity. The singulator module 400 receives a stack of envelopes (not shown), or other mailpieces such as postcards, folders and the like, and separates and feeds them in a seriatim fashion (one at a time) in a path of travel as indicated by arrow A. The conveyor apparatus 200 feeds the envelopes 20 in the path of travel along a deck 240 past the printer module 100 so that a postal indicia can be printed on each envelope 20. Together, the singulator module 400 and the conveyor module 200 make up a transport apparatus for feeding the envelopes 20 through the various modules of the mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

Since the details of the singulator module 400 are not necessary for an understanding of the present invention, no further description will be provided. However, an example of a singulator module suitable for use in conjunction with the present invention is described in U.S. Pat. No. 4,7978, 114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector 504 are located in opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to shafts 244 and 246, respectively, which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck 240. This is commonly referred to as top surface registration which is beneficial for ink jet printing. Any variation in thickness of the envelope 20 is taken up by the deflection of the normal force rollers 234. Thus, a constant space is set between the envelope 20 and the printer module 100 no matter what the thickness of the envelope 20. The constant space is optimally set to a desired value to achieve quality printing. It is important to note that the deck 240 contains suitable openings (not shown) for the endless belt 210 and normal force rollers 234.

A more detailed description of the conveyor apparatus 200 is found in copending U.S. patent application Ser. Co./No. 08/717,788; filed on Sep. 23, 1996, and entitled MAILING MACHINE (Attorney Docket E-516), the disclosure of which is specifically incorporated herein by reference.

Figure 1A:
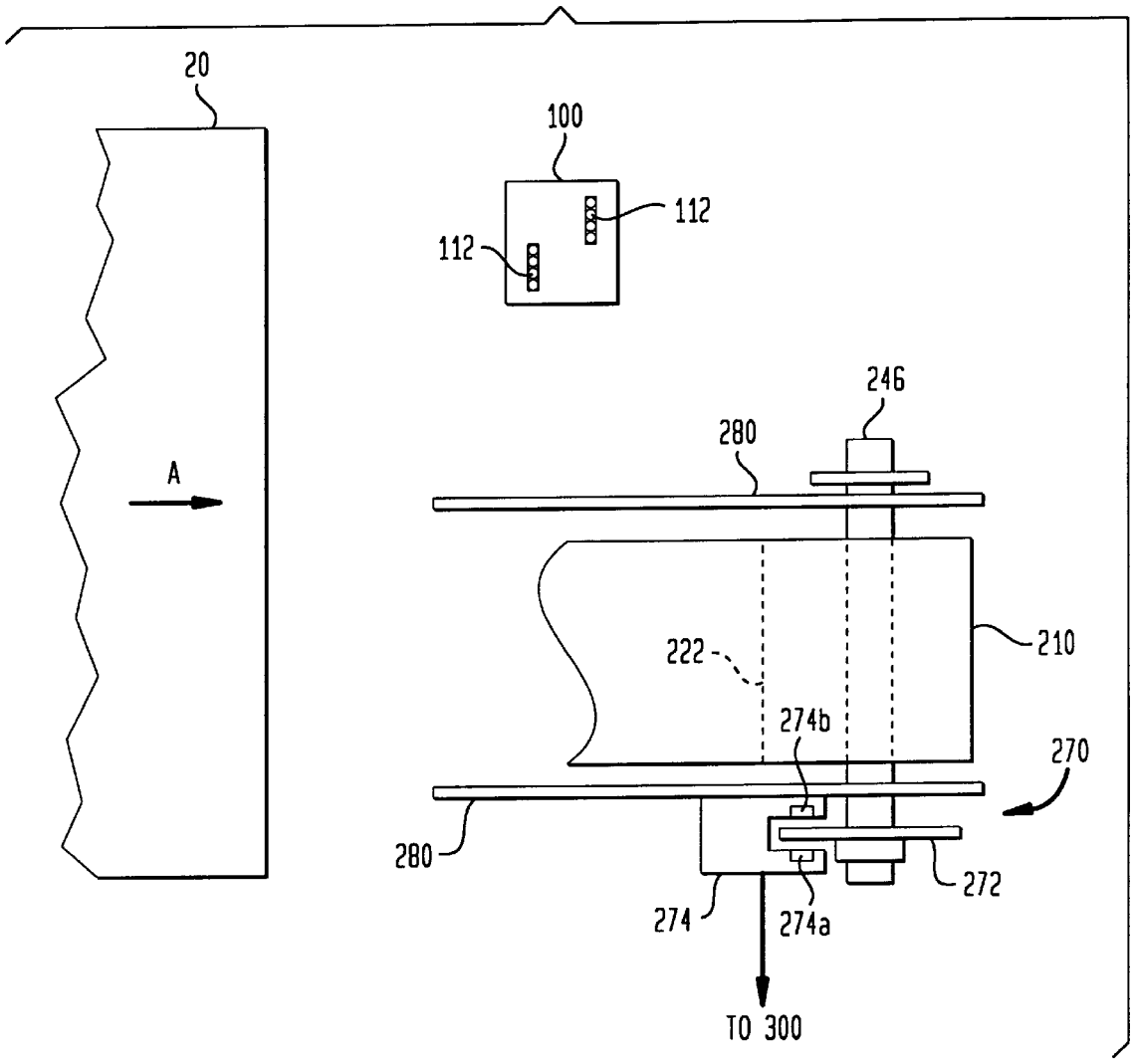
FIG. 1A is a schematic representation of a plan view of an encoder pulley and an encoder system in accordance with the invention.

Referring to FIGS. 1 and 1A, the transport apparatus 200 also includes an encoder system 270 which is located proximate to the printer module 100 and operatively coupled to the encoder pulley 222. The encoder system 270 includes an encoder disk 272 fixably mount to the shaft 246 and an encoder detector 274 fixably mounted to a frame 280. Thus, as the encoder pulley 222 rotates so does the encoder disk 272. The encoder disk 272 has a plurality of vanes located around its circumference and is of a conventional type, such as model number HP 5100 available from Hewlett-Packard Company. The encoder detector 274 is also of conventional type, such as model number HP 9100 available from Hewlett-Packard Company, and includes a light source 274*a* and a light detector 274*b*. The encoder disk 272 and the encoder detector 274 are positioned with respect to each other so that the vanes of the encoder disk 272 alternately block and unblock the light source 274*a* as the shaft 246 rotates. The transition from blocked to unblocked or vice versa result in a change of state or encoder signal (also commonly referred to as a "count") for the encoder detector 274. The encoder disk 272 has been selected so that 1024 counts occur per revolution. In this manner, the position and speed of the shaft 246 can be tracked. This type of encoder system 270 is well known and those skilled in the art will recognize other means for encoding which would serve equally well.

In the preferred embodiment, the printer module 100 includes a first and second row of nozzles 112 which may correspond to individual print heads which have been assembled together to form the print head module 100. Generally, the distance between the first row the second of nozzles 112 measured along the path of travel is necessary for packaging and performance considerations. Typically, high performance print heads capable of high resolution printing at high speeds are only available in linear arrays of small length. Thus, to print a wide swath across the envelope 20 requires the alignment of multiple print heads in end to end fashion as measured in a direction transverse to the path of travel. The use of multiple print heads in this fashion increases the print zone over which accurate encoding needs to take place because encoding must now occur over the print area plus the distance between the print heads. Those skilled in the art will recognize that any number of print heads can be arranged in this or analogous manners to achieve a desired print quality and speed. However, it is important to note that it is possible for the printer module 100 to only include a single row of nozzles if print quality and/or print speed are reduced or if the print height is sufficiently small.

The transport apparatus 200 and the print head module 100 as described above are under the control of the micro control system 300 which may be of any suitable combination of microprocessors, firmware and software. The micro control system 300 includes a motor controller 310 which is in operative communication with the motor 260, a print head controller 320 which is in operative communication with the printer module 100, a sensor controller which is in operative communication with the sensor module 500, an accounting module 340 for tracking postal funds, a microprocessor 360, a security application specific integrated circuit (ASIC) 370 and a user interface 380 of any suitable design, such as a CRT and keyboard, for receiving inputs from and communicating messages to the user. Additionally, the micro control system 300 is in operative communication with the encoder system 270 via the encoder detector 274. The micro control system 300 constantly compares the actual position of the envelope 20 with the desired position of the envelope 20 and computes appropriate corrective drive signals which are communicated to the motor controller 310. The motor controller 310 then provides energizing signals to the motor 260 in response to the drive signals received from the micro control system 300. Those skilled in the art will recognize that the various components of the micro control system 300 are in operative communication with each other over conventional communication lines, such as a communication bus.

The print head controller 320 provides print data signals to the nozzles 112 of the print head module 100 in response to instructions from the micro control system 300. As an input, the micro control system 300 receives the counts from the encoder detector 274 as the encoder disk 272 alternately blocks and unblocks the encoder detector 274. At each count, the micro control system 300 instructs the print head controller 320 to energize the nozzles 112, appropriately. Thus, a line of print occurs for each count that takes place during printing.

Figure 2:
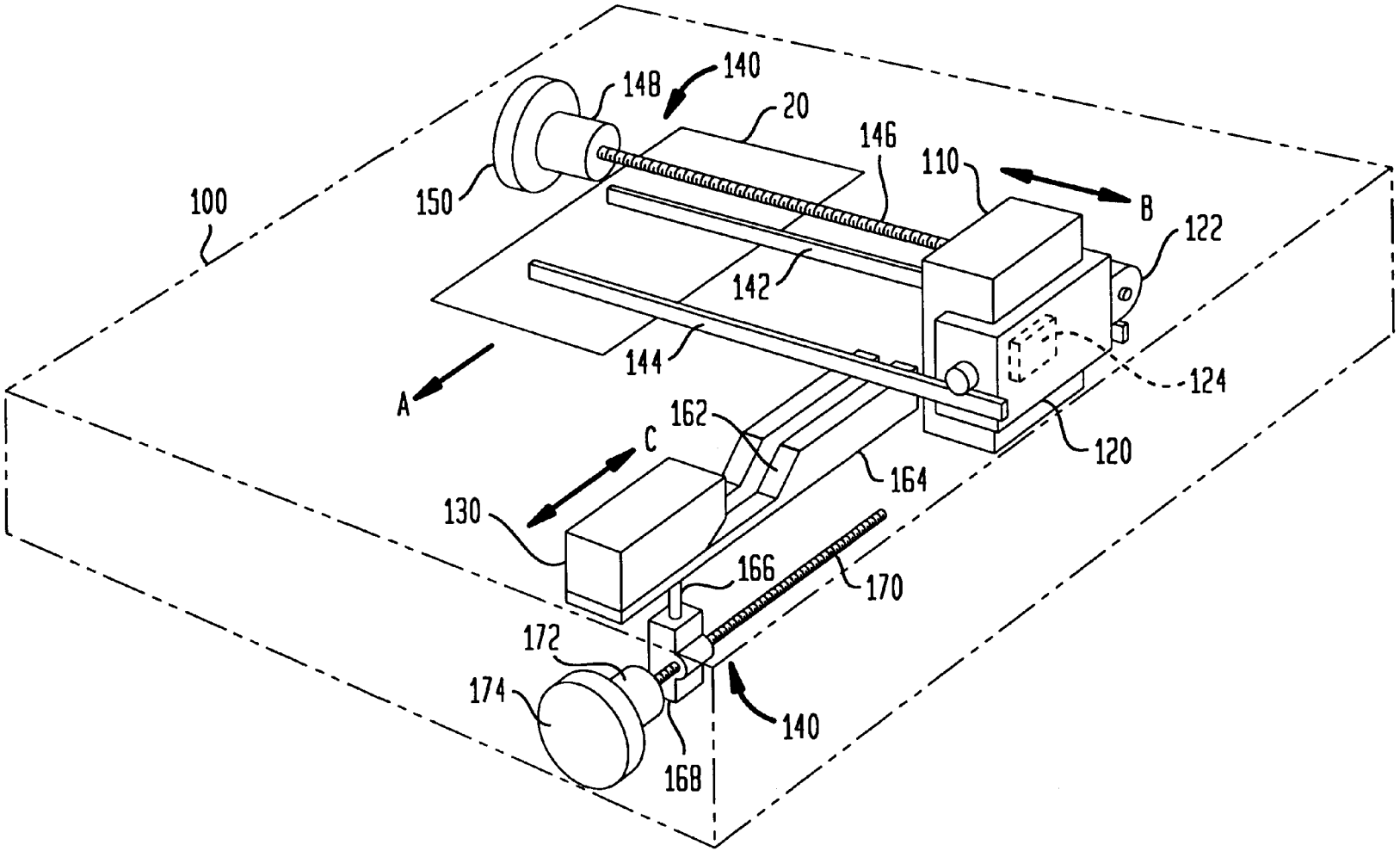
FIG. 2 is a simplified schematic of a perspective view of a printer module including a print cartridge in accordance with the present invention.

Referring to FIG. 2, a more detailed view of the printer module 100 is shown. The printer module 100 includes a carriage 120, an ink jet cartridge 110 detachably mounted to the carriage 120, a maintenance assembly 130 and an assembly 140 for repositioning the carriage 120 and the maintenance assembly 130 into and out of operative engagement. The ink jet cartridge 110 is detachably mounted to a connector 124 which is in turn fixably mounted to the carriage 120. Print data signals are supplied to the ink jet cartridge 110 from the print head controller 320 via the connector 124. The maintenance assembly 130 operates to wipe and cap the cartridge 110 in conventional fashion. The print module 100 further includes suitable framework (not shown) for supporting the various components of the print module 100.

The printer module 100 is used for printing a postal indicia on the envelope 20, which travels in the direction indicated by the arrow A. The repositioning assembly 140 includes a pair of rails 142 and 144, respectively, on which the carriage 120 rests. A lead screw 146 is driven by a drive motor 148 and threadingly engages a nut 122 fixably attached to the carriage 120 in order to translate the carriage 120 back and forth along the rails 142 and 144 as indicated by a double sided arrow B. A conventional encoder system 150 is operatively connected to the drive motor 148 for providing signals indicative of the position of the carriage 120 along the lead screw 146. The carriage 120 can be stopped at various positions along the lead screw 146 depending upon whether the cartridge 110 is printing or engaged with the maintenance assembly 130.

The repositioning assembly 140 further includes suitable structure for repositioning the maintenance assembly 130. The maintenance assembly 130 travels along a track 164 having a camming surface 162 as indicated by a double sided arrow C. A pin 166 engages an aperture (not shown) in the maintenance assembly 130 to reposition the maintenance assembly 130 along the track 164. The pin 166 is seated in a block 168 which threadingly engages a lead screw 170 which in turn is driven by a drive motor 172. Additionally, a conventional encoder system 174 is operatively connected to the drive motor 172 for providing signals indicative of the position of the maintenance assembly 130 along the lead screw 170. The maintenance assembly 130 can be stopped at various positions along the lead screw 170 depending upon whether the cartridge 110 is printing or engaged with the maintenance assembly 130.

Figure 3:
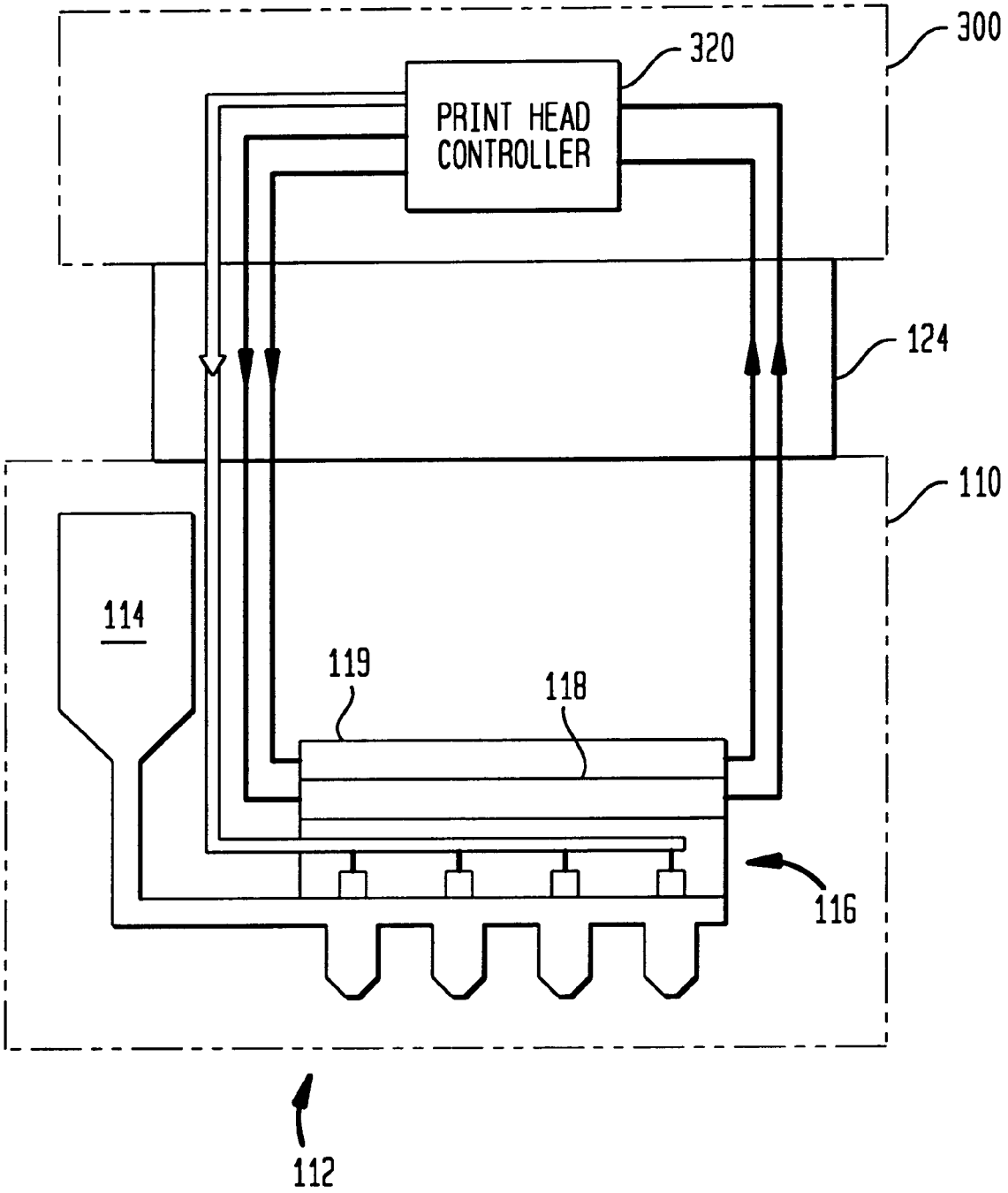
FIG. 3 is a more detailed schematic of the print cartridge in accordance with the present invention.

Referring to FIG. 3, a more detailed view of the ink jet cartridge 110 is shown. The ink jet cartridge 110 includes the array of nozzles 112, a supply of ink 114 and a plurality of ejection elements 116 connecting the array of nozzles 112 with ink supply 114, respectively. Activation of each of the ejection elements 116 is selectively controlled by suitable print data signals provided by the print head controller 320 which cause ink 114 to be expelled from the array of nozzles 112 in a predetermined manner. In the preferred embodiment, the plurality of ejection elements 116 are bubble jet type elements. The ink jet cartridge 110 further includes feed back devices in the form of a diode 118 and a resistor 119 which provide calibration information to the print head controller 320 as to the operating conditions of the cartridge 110. Since the diode 118 has a known operating behavior with respect to temperature, by applying a known voltage to the diode 118 and measuring the corresponding output current, the print head controller 320 can calculate the ambient temperature. In similar fashion, by applying a known voltage to the resistor 119 and measuring the corresponding output current, the print head controller 320 can calculate the sensitivity of the resistor 119 (sometimes referred to as an inherent resistor or a rank resistor). Both the ambient temperature and the resistor sensitivity are calibration inputs which are used to optimize the print data signals supplied to the ejection elements 116 to produce quality printed images. In the preferred embodiment, there is one diode 118 and one resistor 119 mounted directly to the silicone substrate which comprises the ejection elements 116. Those skilled in the art will recognize that each one of the ejection elements 116 could have its own diode and resistor or that the ejection elements 116 could be grouped into functional blocks with each block having its own diode and resistor.

Each cartridge 110 is initially filled with a predetermined amount of ink 114. Since ink 114 is used during printing and maintenance operations, the ink 114 will be gradually consumed over time and eventually a new cartridge 110 will need to be installed. To keep track of the amount of ink 114 available, the print head controller 320 estimates an amount of ink 114 used during operation and subtracts this amount from the initial predetermined amount to obtain an estimate of an amount of ink 114 remaining. Any conventional technique for estimating ink used, such as counting ink drops, may be employed. In this manner, the user can be instructed as to when the cartridge 110 should be replaced. In the alternative, a system (not shown), such as a thermistor in the ink reservoir, can be employed for actively measuring the amount of remaining ink.

Figure 4:
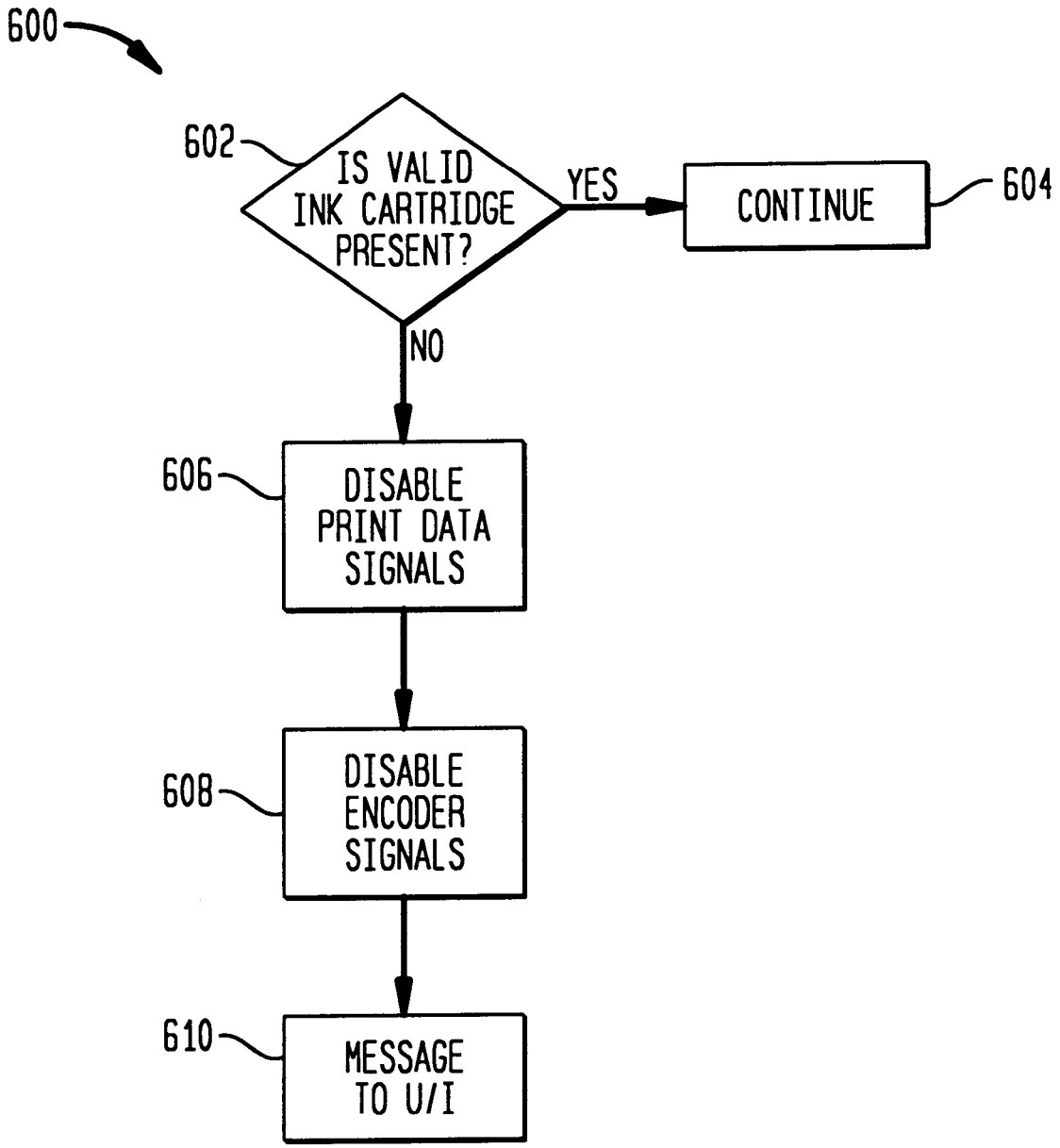
FIG. 4 is a flow chart showing the operation of the mailing machine in accordance with the present invention.

With the structure of the mailing machine 10 described as above, the operational characteristics will now be described. Referring primarily to FIG. 4 while referencing the structure of FIGS. 1, 1*a*, 2 and 3, a flow chart of routine 600 summarizing the operation of the mailing machine 10 in accordance with the present invention is shown. Generally, the micro processor 360 and the security ASIC 370 oversee the operation of the routine 600. At 602, a determination is made whether or not the ink jet cartridge 110 is installed in the carriage 124. This determination is made prior to printing the postal indicia and also prior to feeding the envelope 20 in the path of travel. This is achieved by applying a predetermined voltage to the resistor 119 and measuring the corresponding output current. From this information the micro control system 300 can determine if an ink jet cartridge 110 is installed and also calculate the resistance of the resistor 119 that is present. If the determined resistance of the resistor 119 is within a predetermined range, then the micro control system 300 will determine that the ink jet cartridge is valid. If the determined resistance of the resistor 119 is not within a predetermined range, then the micro control system 300 will determine that the ink jet cartridge is not valid. This may be due to the absence of an ink jet cartridge 110, an authorized but faulty ink jet cartridge 110, or the installation of an unauthorized ink jet cartridge 110. In any such scenario, it is desirable to disable the mailing machine 10 so that the print data signals will not reach the connector 124. Those skilled in the art will recognize that other techniques for determining if an ink jet cartridge 110 is installed are available, such as providing an interlock switch (not shown) or proximity sensor (not shown).

Based on the above, if at 602 the answer is yes, then at 604 the mailing machine continues with normal operations. On the other hand, if at 602 the answer is no, then at 606 the micro control system 300 disables the print data signals from reaching the connector 124. This can be achieved in a variety of ways. First, the output from the print controller 320 can be surpressed so that no print data signals are transmitted to the connector 124. Second, the accounting module 340 can be instructed not to produce a token. Tokens are well known in the field of electronic postage metering. The token is a necessary input to the creation of print data signals as it contains relevant information with respect to the postal indicia that is to be printed. That is, the token serves as a necessary input to the generation of print data signals. Without a token, no print data signals are produced. Those skilled in the art will recognize still other ways of preventing the print data signals from reaching the connector 124.

Next, at 608 the micro control system 300 disables mailing machine 10. This is achieved by instructing the encoder detector 274 not to transmit any encoder signals. Thus, printing is disabled because the encoder signals are necessary to properly coordinate the firing of the nozzles 112 with the movement of the envelope 20 to produce a quality postal indicia. Also, the motor controller 310 does not supply any drive signals to the motors 470 and 260, respectively. As a result, the mailing machine 10 will not be able to feed envelope 20. Next, at 610 the micro control system 300 sends a message to the user interface 380 instructing the user to install an approved ink jet cartridge 110 in the carriage 120 and power reset the mailing machine 10.

Base on the above description and the associated drawings, it should now be apparent that the present invention substantially reduces the risk of fraud as described above by inhibiting the print data signals from appearing in the open at the connector 124 and by shutting down the mailing machine 10 equipment from functioning.

Many features of the preferred embodiment represent design choices selected to best exploit the inventive concept as implemented in a mailing machine. However, those skilled in the art will recognize that various modifications can be made without departing from the spirit of the present invention. For example, the preferred embodiments are described with respect to bubble jet technology, however, those skilled in the art will readily be able to adapt the inventive concepts to piezoelectric technology an a repackaging of the components that embody the ink jet printing apparatus.

Therefore, the inventive concept in its broader aspects is not limited to the specific details of the preferred embodiments but is defined by the appended claims and their equivalents.

What is claimed is:

1. A mailing machine comprising:

a printer module including a connector, a print head controller for producing print data signals necessary to print a postal indicia on an envelope and a replaceable print head cartridge having a plurality of print elements which are selectively energized in response to the print data signals, the print head cartridge detachably mounted to the connector;

an accounting module in operative communication with the printer module for producing a token necessary to generate the print data signals;

control means in operative communication with the accounting module and the printer module for:

determining if a valid print head cartridge is installed; and if a valid print head cartridge is not installed, disabling the accounting module for producing the token.

2. The mailing machine of claim 1, wherein:

to prevent the print data signals from reaching the connector, the control means disables the print head controller from producing the print data signals.

3. The mailing machine of claim 2, further comprising:

a transport means for feeding the envelope past the plurality of print elements; and encoder means operatively coupled to the transport means for providing encoder signals indicative of the position of the envelope, the encoder means, the transport means and the print head controller for synchronizing the feeding of the envelope with energizing of the plurality of print elements of the print head module; and wherein the control means is in operative communication with the encoder means and is further for:

if the valid print head cartridge is not installed, disabling the encoder means from producing the encoder signals.

4. The mailing machine of claim 3, further including:

a motor operatively connected to the transport means; and a motor controller operatively connected to the motor and the control means for transmitting suitable drive signals to the motor; and wherein:

if the valid print head cartridge is not installed, the control means disables the motor controller from transmitting drive signals.

5. The mailing machine of claim 4, wherein:

the ink jet cartridge includes a rank resistor having a resistance;

the control means measures the resistance of the rank resistor located within the print head cartridge; and if the measured resistance is not within a predetermined range, the control means determines that the print head cartridge is not valid.

6. The mailing machine of claim 1, wherein:

the ink jet cartridge includes a rank resistor having a resistance;

the control means measures the resistance of the rank resistor located within the print head cartridge; and if the measured resistance is not within a predetermined range, the control means determines that the print head cartridge is not valid.

7. The mailing machine of claim 6, wherein:

to prevent the print data signals from reaching the connector, the control means disables the print head controller from producing the print data signals.

8. The mailing machine of claim 7, further comprising:

a transport means for feeding the envelope past the plurality of print elements; and encoder means operatively coupled to the transport means for providing encoder signals indicative of the position of the envelope, the encoder means, the transport means and the print head controller for synchronizing the feeding of the envelope with energizing of the plurality of print elements of the print head module; and wherein the control means in operative communication with the encoder means and is further for for:

if the valid print head cartridge is not installed, disabling the encoder means from producing the encoder signals.

9. The mailing machine of claim 8, further including:

a motor operatively connected to the transport means; and a motor controller operatively connected to the motor and the control means for transmitting suitable drive signals to the motor; and wherein:

if the valid print head cartridge is not installed, the control means disables the motor controller from transmitting drive signals.

10. The mailing machine of claim 1, further comprising:

a transport means for feeding the envelope past the plurality of print elements; and encoder means operatively coupled to the transport means for providing encoder signals indicative of the position of the envelope, the encoder means, the transport means and the print head controller for synchronizing the feeding of the envelope with energizing of the plurality of print elements of the print head module; and wherein the control means in operative communication with the encoder means and is further for:

if the valid print head cartridge is not installed, disabling the encoder means from producing the encoder signals.

11. The mailing machine of claim 10, further including:

a motor operatively connected to the transport means; and a motor controller operatively connected to the motor and the control means for transmitting suitable drive signals to the motor; and wherein:

if the valid print head cartridge is not installed, the control means disables the motor controller from transmitting drive signals.

12. The mailing machine of claim 11 wherein:

to prevent the print data signals from reaching the connector, the control means disables the print head controller from producing the print data signals.

* * * * *